US011141976B2

(12) United States Patent
Odaka et al.

(10) Patent No.: US 11,141,976 B2
(45) Date of Patent: Oct. 12, 2021

(54) LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventors: Toshimichi Odaka, Kanagawa (JP); Yoshitaka Fujinuma, Ibaraki (JP); Koji Kawahara, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/800,982

(22) Filed: Feb. 25, 2020

(65) Prior Publication Data

US 2020/0276818 A1 Sep. 3, 2020

(30) Foreign Application Priority Data

Feb. 28, 2019 (JP) ..... JP2019-036422

(51) Int. Cl.
*B41J 2/165* (2006.01)
*B41J 2/14* (2006.01)

(52) U.S. Cl.
CPC ..... *B41J 2/16505* (2013.01); *B41J 2/1433* (2013.01); *B41J 2002/14491* (2013.01)

(58) Field of Classification Search
CPC ..... B41J 2/1433; B41J 2/16505; B41J 2002/14362; B41J 2/14201
See application file for complete search history.

(56) References Cited

U.S. PATENT DOCUMENTS

2017/0232741 A1* 8/2017 Kikuchi ..... H01R 12/77 347/50

FOREIGN PATENT DOCUMENTS

JP 2004-090474 3/2004
JP 2014-019128 2/2014

* cited by examiner

*Primary Examiner* — Jason S Uhlenhake
(74) *Attorney, Agent, or Firm* — Xsensus LLP

(57) ABSTRACT

A liquid discharge head includes a nozzle, a cover, a connector board, and a cap. The nozzle is configured to discharge liquid. The cover covers at least a part of the liquid discharge head except the nozzle. The connector board includes a connector, and a first engaging portion. The connector is detachably connected to a wiring component. The first engaging portion is configured to engage the cover in a first direction. The cap is detachably attached to the cover. The cap includes an opening and a second engaging portion. The opening is configured to engage at least one of the connector and the connector board in a second direction intersecting the first direction and expose at least a part of the connector. The second engaging portion is configured to engage the cover in a third direction.

18 Claims, 10 Drawing Sheets

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-036422, filed on Feb. 28, 2019, in the Japan Patent Office, the entire disclosure of which is incorporated by reference herein.

BACKGROUND

Technical Field

Aspects of the present disclosure relate to a liquid discharge head, a liquid discharge device, and a liquid discharge apparatus.

Related Art

A configuration in which a head main unit and a wiring component (such as a flexible wiring component) that transmits a signal for driving a pressure generator of the head main unit from outside are detachably connected with a connector is known as a liquid discharge head that discharges liquid such as ink.

As the head and the wiring component are connected via the connector in this configuration, the length of the wiring component can be appropriately selected depending on the printing environment, and the liquid discharge head can be easily attached or easily replaced with another liquid discharge head.

Generally, a connector is disposed on a connector board, and is electrically connected to a driving element through the connector board. The connector board is attached and secured to a cover that covers the outer periphery of the components that form a liquid supply channel, a flow channel, and the like of the head. To secure the connector board to the cover, a fixing member such as a pin, or an adhesive may be used, for example.

In a case where components are attached to the cover (a frame) with an adhesive in a liquid discharge head, there may be a problem in its fixability. For example, in a mode in which a cap receiving plate that receives a cap is bonded to the cover with an adhesive, detachment or peel-off of the cap receiving plate might occur when the cap is attached or detached. To counter such a problem, for example, a technique has been proposed in which slide engaging portions are provided to create an engaged state to attach target components.

SUMMARY

In an aspect of the present disclosure, there is provided a liquid discharge head that includes a nozzle, a cover, a connector board, and a cap. The nozzle is configured to discharge liquid. The cover covers at least a part of the liquid discharge head except the nozzle. The connector board includes a connector and a first engaging portion. The connector is detachably connected to a wiring component. The first engaging portion is configured to engage the cover in a first direction. The cap is detachably attached to the cover. The cap includes an opening and a second engaging portion. The opening is configured to engage at least one of the connector and the connector board in a second direction intersecting the first direction and expose at least a part of the connector. The second engaging portion is configured to engage the cover in a third direction.

In another aspect of the present disclosure, there is provided a liquid discharge device that includes a movable carriage and a plurality of liquid discharge heads. The liquid discharge heads are mounted on the carriage. The liquid discharge heads include a nozzle, a cover, a connector board, and a cap. The nozzle is configured to discharge liquid. The cover covers at least a part of the liquid discharge heads except the nozzle. The connector board includes a connector and a first engaging portion. The connector is detachably connected to a wiring component. The first engaging portion is configured to engage the cover in a first direction. The cap is detachably attached to the cover. The cap includes an opening and a second engaging portion. The opening is configured to engage at least one of the connector and the connector board in a second direction intersecting the first direction and expose at least a part of the connector. The second engaging portion is configured to engage the cover in a third direction.

In still another aspect of the present disclosure, there is provided a liquid discharge apparatus that includes a cartridge, a feed tray, and an ejection tray. The cartridge is configured to store liquid. The feed tray is configured to feed a medium. The ejection tray is configured to receive the medium. The liquid discharge device is configured to receive the liquid from the cartridge. The liquid discharge device that includes a movable carriage and a plurality of liquid discharge heads. The liquid discharge heads are mounted on the carriage. The liquid discharge heads include a nozzle, a cover, a connector board, and a cap. The nozzle is configured to discharge liquid. The cover covers at least a part of the liquid discharge heads except the nozzle. The connector board includes a connector and a first engaging portion. The connector is detachably connected to a wiring component. The first engaging portion is configured to engage the cover in a first direction. The cap is detachably attached to the cover. The cap includes an opening and a second engaging portion. The opening is configured to engage at least one of the connector and the connector board in a second direction intersecting the first direction and expose at least a part of the connector.

The second engaging portion is configured to engage the cover in a third direction.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
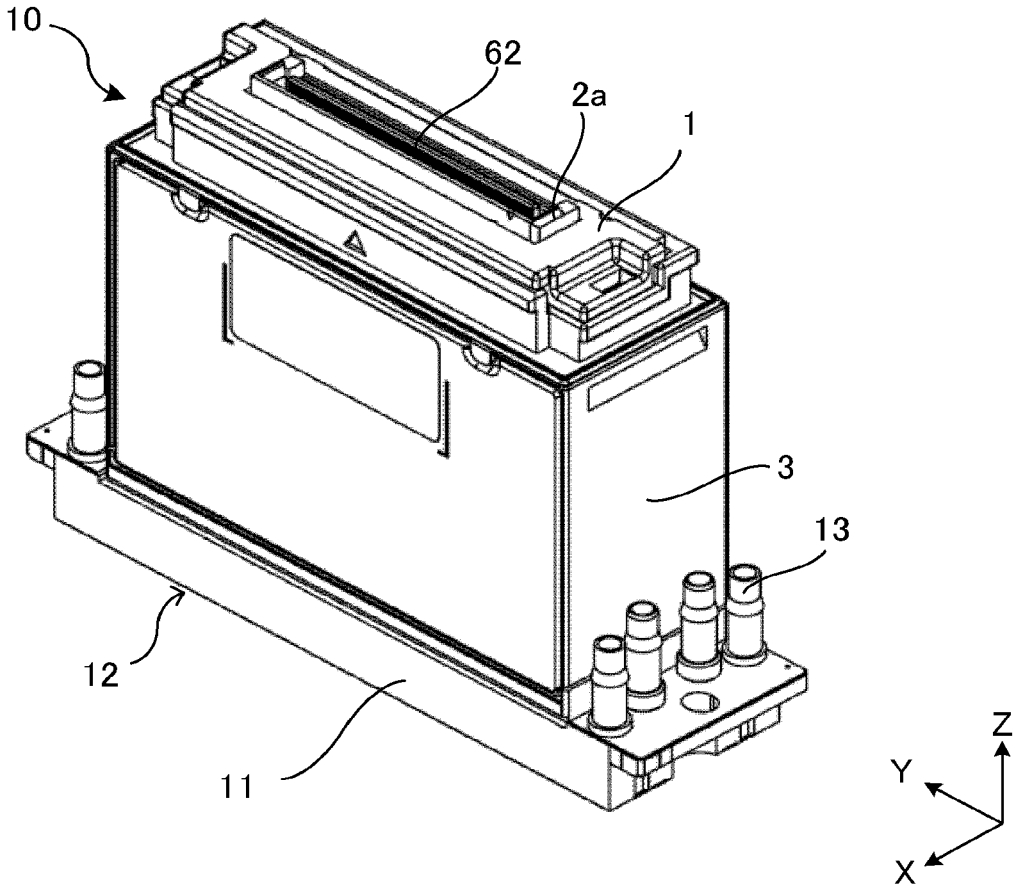
FIG. 1 is an external perspective view of an example of a liquid discharge head according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Referring to FIGS. 1 through 6D, a liquid discharge head according to an embodiment of the present disclosure is described. FIG. 1 is an external perspective view of an example of a liquid discharge head according to the present embodiment. FIGS. 2A through 2D are diagrams for explaining a cap forming the liquid discharge head of the present embodiment. FIGS. 3A through 3D are diagrams for explaining a connector board. FIGS. 4A through 4D are diagrams for explaining a cover. FIGS. 5A through 5D are diagrams for explaining a state in which the connector board is attached to the cover. FIGS. 6A through 6D are diagrams for explaining a state in which a cap is further attached to the cover. In FIGS. 2A through 6D, each drawing A is a top view, each of drawings B and C is a side view in the longitudinal direction and the short-side direction, and each drawing D is a perspective view.

As illustrated in FIG. 1, a liquid discharge head 10 includes a head main unit 11 that discharges liquid from nozzles. The head main unit 11 has a nozzle surface (i.e., a surface of a nozzle plate) 12 on which a plurality of nozzles is arranged, and includes a common-chamber substrate forming a common liquid chamber that supplies liquid to individual liquid chambers communicating with the nozzles, and a driving element unit including a pressure generator that applies pressure to the liquid in each individual liquid chamber. The pressure generator of the driving element unit is formed with a piezoelectric actuator or a thermal actuator, for example.

The head main unit 11 also includes a liquid supply port unit 13 that is connected to an external liquid supply source, and supplies liquid to the common liquid chamber. The supplied liquid is supplied to the common liquid chamber through a supply path in the head, and is further supplied from the common liquid chamber to the individual liquid chambers. When the pressure generator is driven, the liquid is discharged from the nozzles.

The liquid discharge head 10 includes a cover 3 that covers the outer periphery of the components that constitute the liquid supply path, the liquid chambers, and the like. Where the liquid discharge direction of the liquid discharge head 10 is a downward direction, an opening 63 is formed in the upper portion of the cover 3 as illustrated in FIGS. 4A through 4D, and a connector 2*a* is disposed in the opening 63 so as to protrude as illustrated in FIGS. 5A through 5D.

Figure 2A:
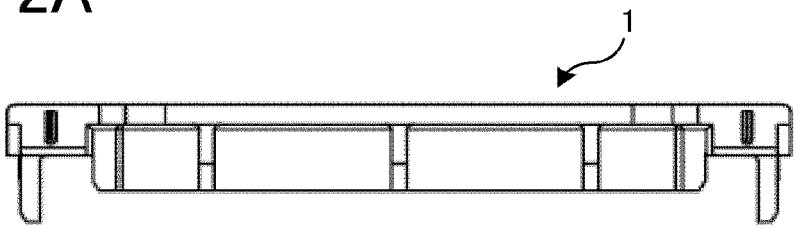
FIG. 2A is a top view for explaining an example of a cap forming the liquid discharge head of the present embodiment.
Figure 2B:
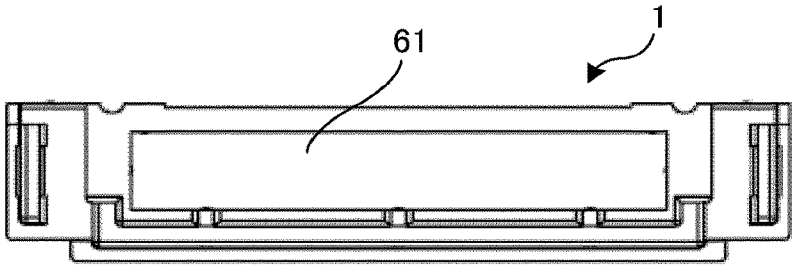
FIGS. 2B and 2C are side views of the cap.
Figure 2C:
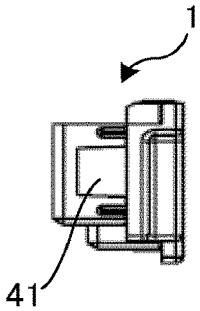
Figure 2D:
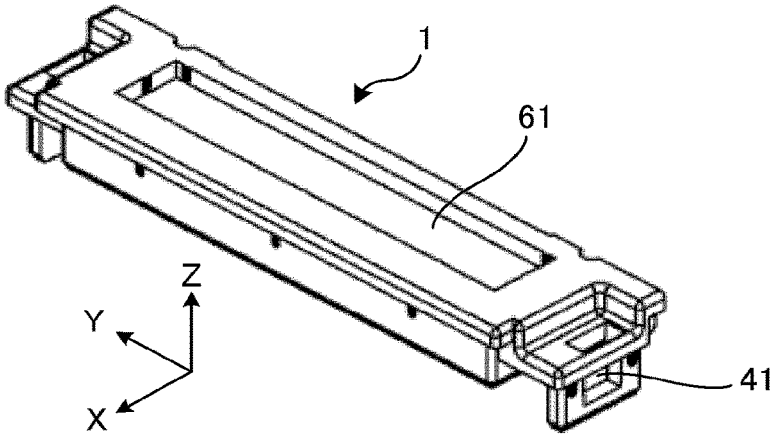
FIG. 2D is a perspective view of the cap.

Further, a cap 1 for covering the opening 63 is detachably attached to the cover 3. The cap 1 has an opening 61 as illustrated in FIGS. 2B, 2C, and 2D. As illustrated in FIG. 1 and FIGS. 6A through 6D, a terminal unit 62 to be connected to a wiring component is disposed so as to be exposed through the opening 61 of the cap 1.

As illustrated in FIGS. 3A through 3D, the connector 2*a* is disposed in the vicinity of the upper end portion of the substrate portion 2*b* of a connector board 2 and is electrically connected to the driving element unit through the substrate portion 2*b*. A flexible wiring component to be connected to a drive circuit or the like is detachably connected to the terminal unit 62 of the connector 2*a*. As a result, the liquid discharge head 10 is connected to the drive circuit on the main unit side of the apparatus (the liquid discharge apparatus that will be described later) on which the liquid discharge head 10 is mounted.

As the flexible wiring component is detachably connected to the connector board 2, assembling is facilitated, and the degree of freedom of layout of the internal configuration of the apparatus becomes higher. Further, as the flexible wiring component is designed to be detachable, the same liquid discharge head can be used even if the lengths of flexible wiring components vary with device models. Accordingly, the head can be more versatile than a head having a structure in which the flexible wiring component is not detachable.

The liquid discharge head of the present embodiment includes: the cover 3 that covers at least part of the liquid discharge head; the connector board 2 that has the connector 2*a* to which a wiring component is detachably connected, and includes first engaging portions 52 that engage with the cover 3; and the cap 1 that has the opening 61 that exposes at least part of the connector 2*a* while engaging with the connector 2*a* or the connector board 2, includes second engaging portions 41 that engage with the cover 3, and is detachably attached to the cover 3. The direction of engagement of the cover 3 with the connector board 2 intersects with the direction of engagement of the cap 1 with the connector 2*a* or the connector board 2.

Figure 3A:
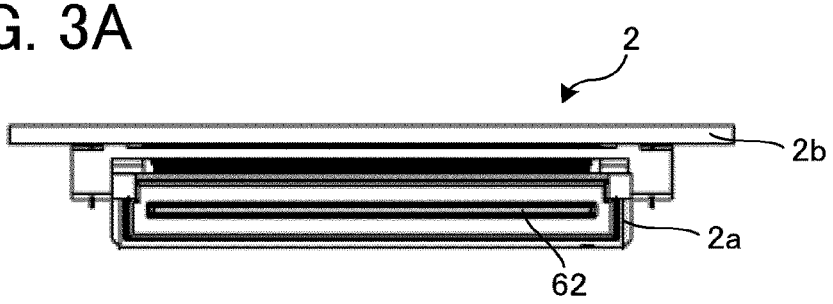
FIG. 3A is a top view for explaining an example of a connector board forming the liquid discharge head of the present embodiment.
Figure 3B:
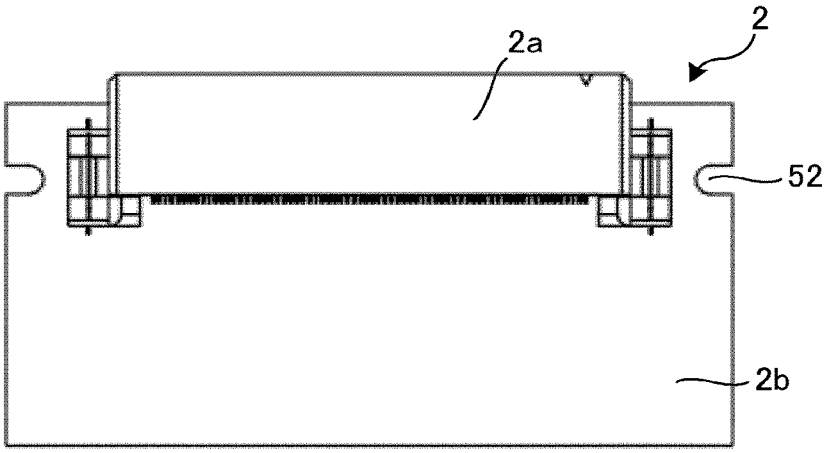
FIGS. 3B and 3C are side views of the connector board.
Figure 3C:
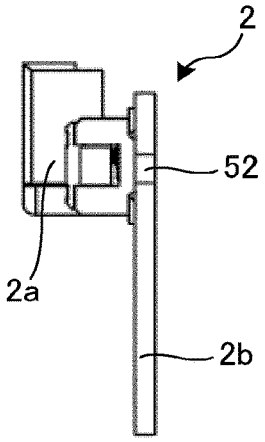
Figure 3D:
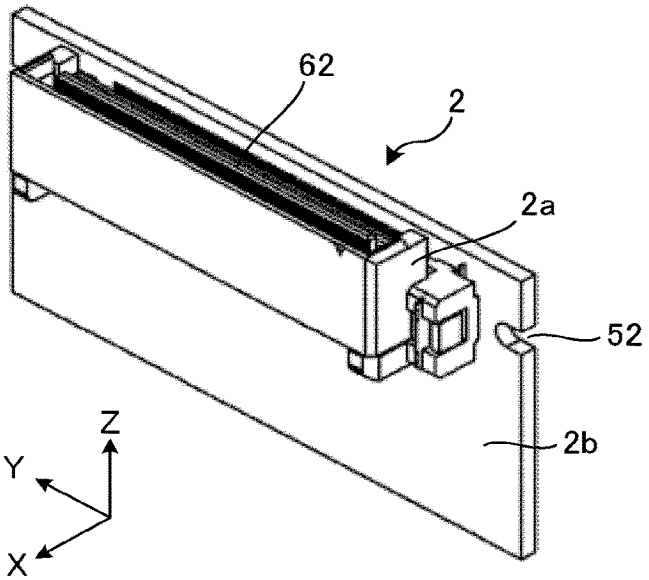
FIG. 3D is a perspective view of the connector board.
Figure 4A:
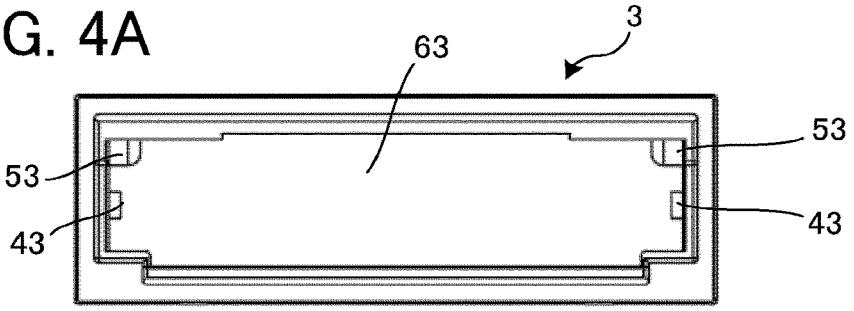
FIG. 4A is a top view for explaining an example of a cover forming the liquid discharge head of the present embodiment.
Figure 4B:
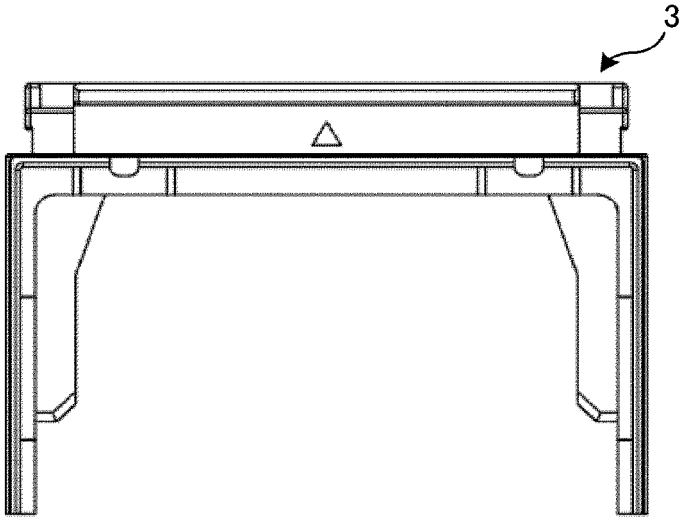
FIGS. 4B and 4C are side views of the cover.
Figure 4C:
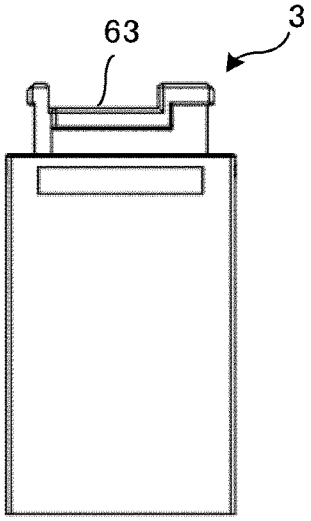
Figure 4D:
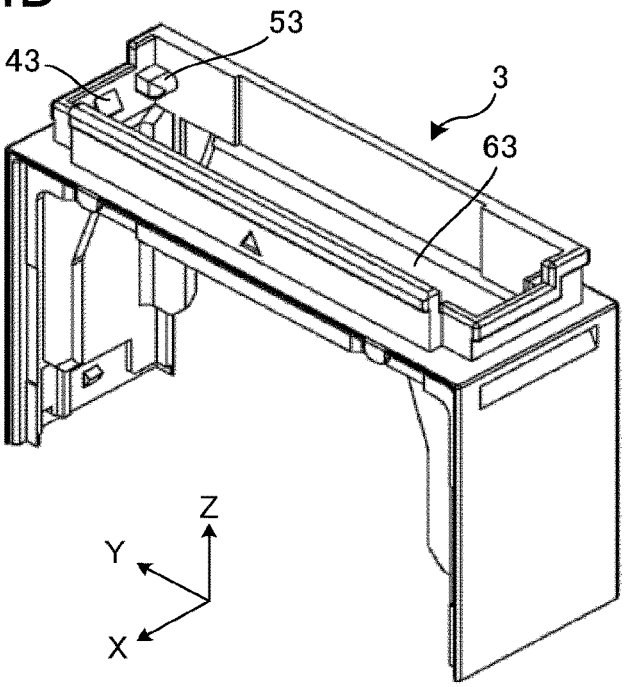
FIG. 4D is a perspective view of the cover.

The first engaging portions (engaging recesses) 52 of the connector board 2 illustrated in FIGS. 3B, 3C, and 3D, and first engaging portions (engaging projections) 53 of the cover 3 illustrated in FIGS. 4A and 4D engage with each other in the Y direction, as illustrated in the perspective views in FIGS. 3D and 4D. With this arrangement, the connector board 2 and the cover 3 are secured as illustrated in FIGS. 5A through 5D, and movement of the connector board 2 (or the installed connector 2*a*) in the Z direction is restricted.

Figure 5A:
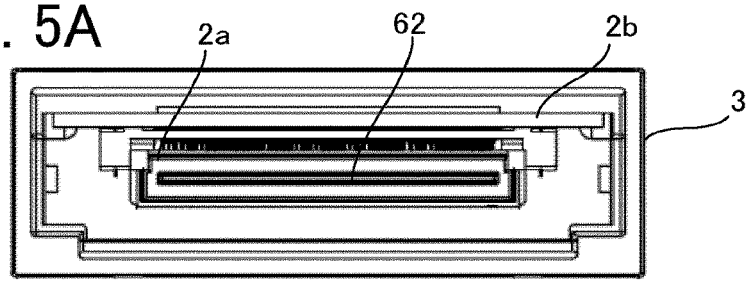
FIG. 5A is a top view for explaining a state in which the connector board is attached to the cover.
Figure 5B:
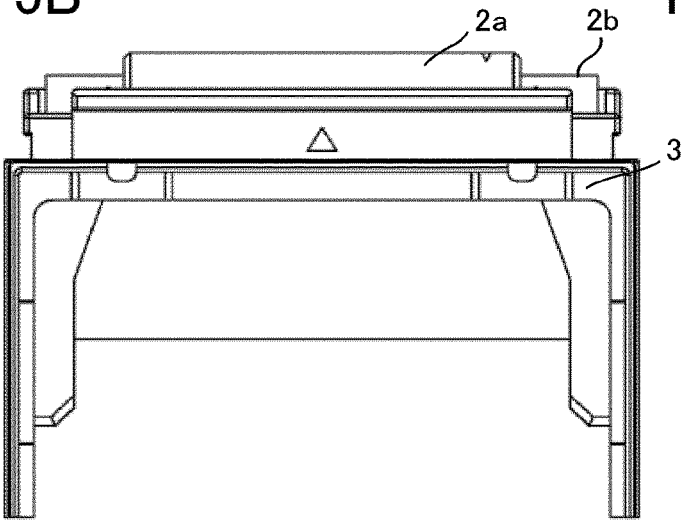
FIGS. 5B and 5C are side views of the connector board attached to the cover.
Figure 5C:
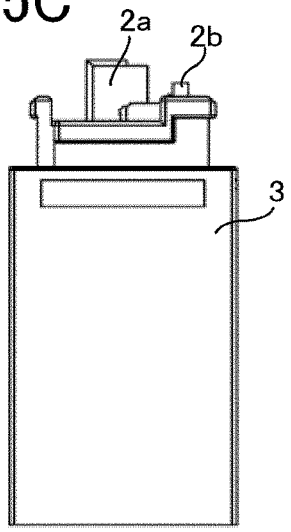
Figure 5D:
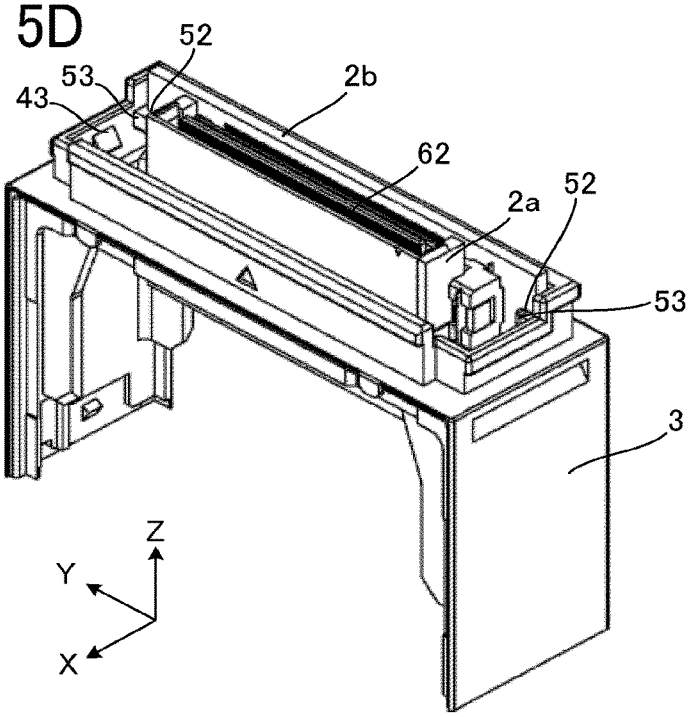
FIG. 5D is a perspective view of the connector board attached to the cover.

In the state illustrated in FIGS. 5A through 5D, on the other hand, the connector 2*a* and the opening 61 of the cap 1 illustrated in FIGS. 2A through 2D engage with each other in the Z direction, as illustrated in the perspective views in FIGS. 2D and 5D. The object to be engaged with the opening 61 may be the substrate portion 2*b* of the connector board 2. With this arrangement, the connector 2*a* and the cap 1 engage with each other, and are secured, as illustrated in FIGS. 6A through 6D. Thus, movement of the connector 2*a* and the connector board 2 in the X and Y directions is restricted.

The direction of engagement of the cover 3 with the connector board 2 is preferably substantially orthogonal to the direction of engagement of the cap 1 with the connector 2*a* (or the connector board 2). As described above, in the present embodiment, the direction of engagement of the cover 3 with the connector board 2 (the Y direction) is orthogonal to the direction of engagement of the cap 1 with the connector 2*a* (the Z direction). Movement of the connector 2*a* and the connector board 2 in the Z direction is restricted by the cover 3, and movement of the connector 2*a* and the connector board 2 in the X and Y directions is restricted by the cap 1. Thus, the connector 2*a* and the connector board 2 are positioned and secured with high precision.

Figure 6A:
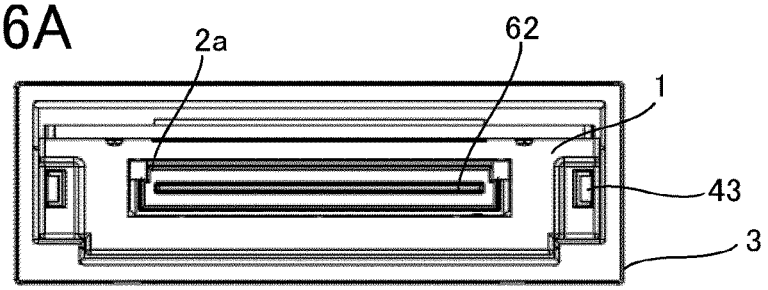
FIG. 6A is a top view for explaining a state in which the cap is attached in the state illustrated in FIG. 5A.
Figure 6B:
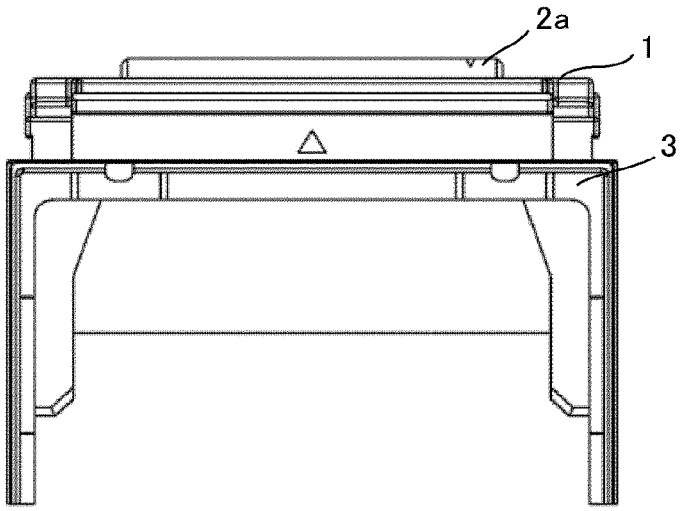
FIGS. 6B and 6C are side views of the cap attached in the state illustrated in FIG. 5B.
Figure 6C:
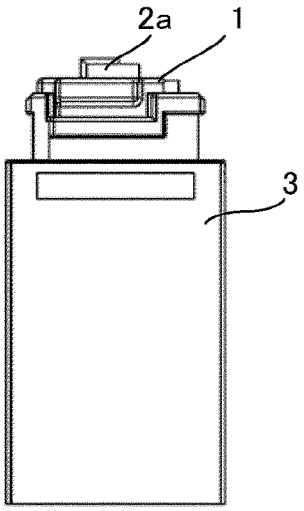
Figure 6D:
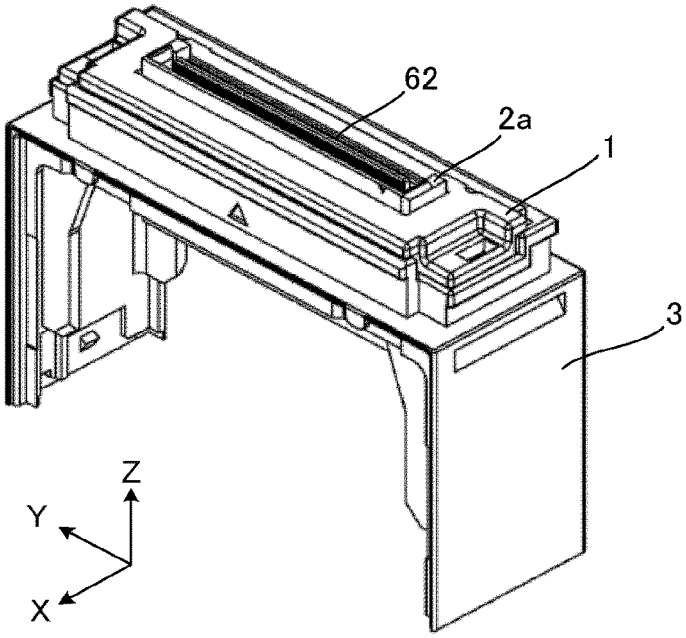
FIG. 6D is a perspective view of the cap attached in the state illustrated in FIG. 5C.

Meanwhile, second engaging portions (engaging projections) 43 of the cover 3 illustrated in FIG. 5D and the second engaging portions (engaging recesses) 41 of the cap 1 illustrated in FIGS. 2B, 2C, and 2D engage with each other in the Y direction, as illustrated in the perspective view in FIG. 6D. With this arrangement, the cap 1 and the cover 3 are secured as illustrated in FIGS. 6A through 6D, and movement of the cap 1 in the Z direction is restricted. The direction of engagement of the cover 3 with the cap 1 is preferably substantially parallel to the direction of engagement of the cover 3 with the connector board 2. In the present embodiment, the direction of engagement of the cover 3 with the cap 1 (the Y direction) is parallel to the direction of engagement of the cover 3 with the connector board 2 (the Y direction).

Further, the cap 1 may be brought into contact with the substrate portion 2*b* of the connector board 2 when attached to the cover 3, and press the substrate portion 2*b* against an inner wall of the cover 3, to secure the substrate portion 2*b*. The connector 2*a* installed on the connector board 2 is disposed so that the terminal unit 62 is exposed through the opening 61 of the cap 1 that has been positioned and secured. With such arrangement, the terminal unit 62 to be connected to the wiring component is positioned with high precision.

With the liquid discharge head of the present embodiment, there is no need to prepare any fixing member and any adhesive that would be necessary for securing the connector board 2 in a conventional manner. Accordingly, the number of assembling procedures required for securing the connector board 2 is reduced, and assembling is facilitated in a preferred manner.

Note that the first engaging portions (engaging recesses) 52 of the connector board 2, the first engaging portions (engaging projections) 53 of the cover 3, the second engaging portions (engaging projections) 43 of the cover 3, and the second engaging portions (engaging recesses) 41 of the cap 1 do not necessarily have the forms illustrated in the drawings, as long as these engaging portions can be secured to restrict movement in the Z direction. "Engagement" is not necessarily a mode in which a recess or a hole and a protrusion or a stick-like (shaft-like) portion engage with each other, but may be a mode in which one object is surrounded by another object, or the surface of one object is covered with another object so that movement of the one object is restricted, for example. The configuration of the engaging portions is not necessarily a configuration in which a recess or a hole and a protrusion or a stick-like (shaft-like) portion engage with each other as in the present embodiment, but may be a configuration in which one object is surrounded by another object, or the surface of one object is covered with another object so that movement of the one object is restricted, for example. Any of these configurations can be selected as appropriate.

Liquid Discharge Device

Figure 7:
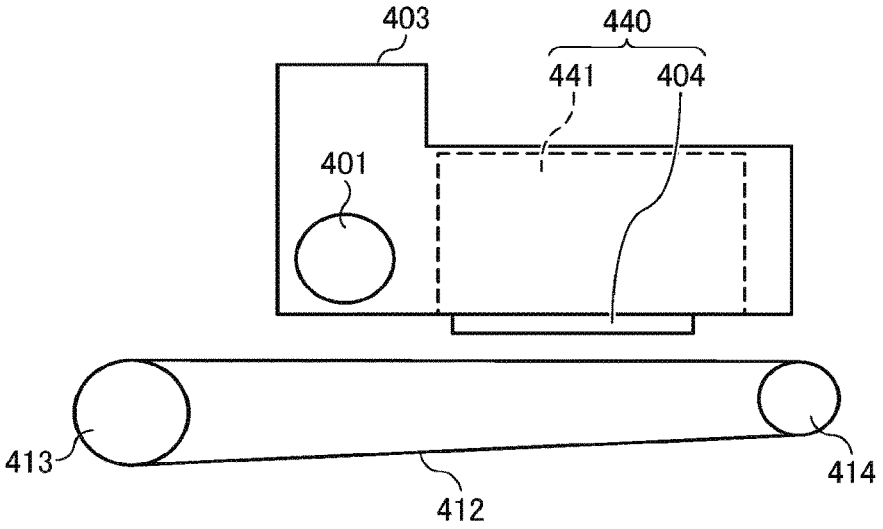
FIG. 7 is a side view illustrating an example of a liquid discharge device.
Figure 8:
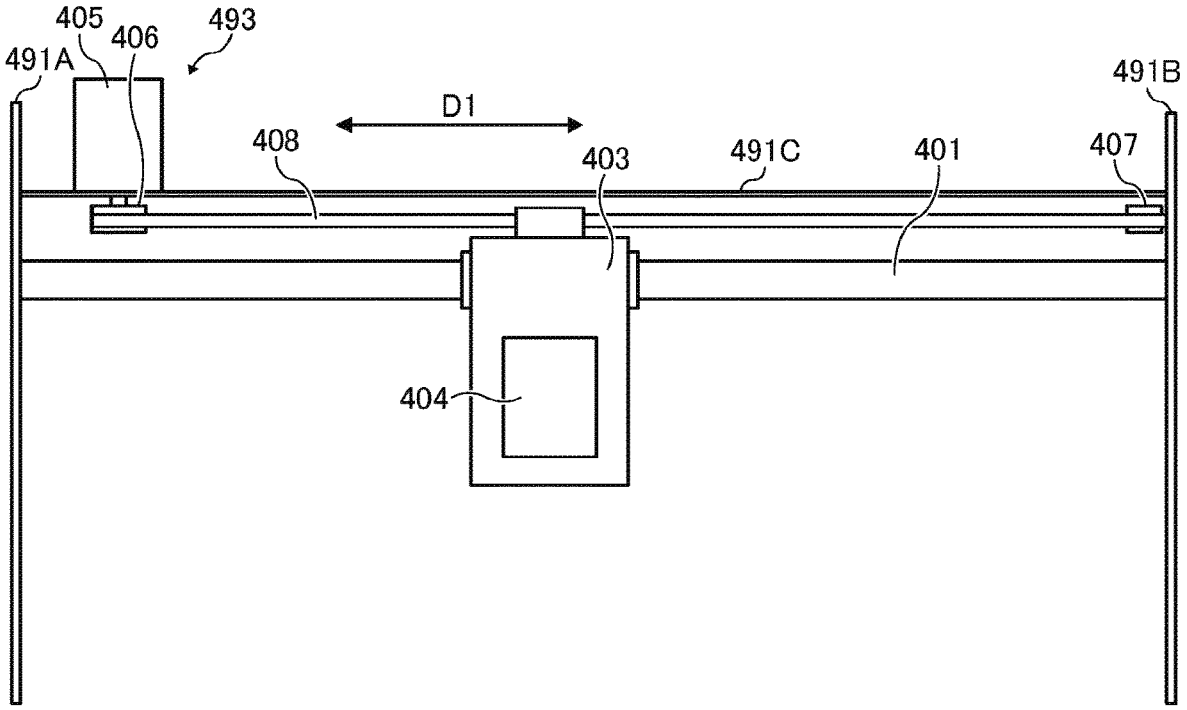
FIG. 8 is a top view illustrating an example of a liquid discharge device.
Figure 9:
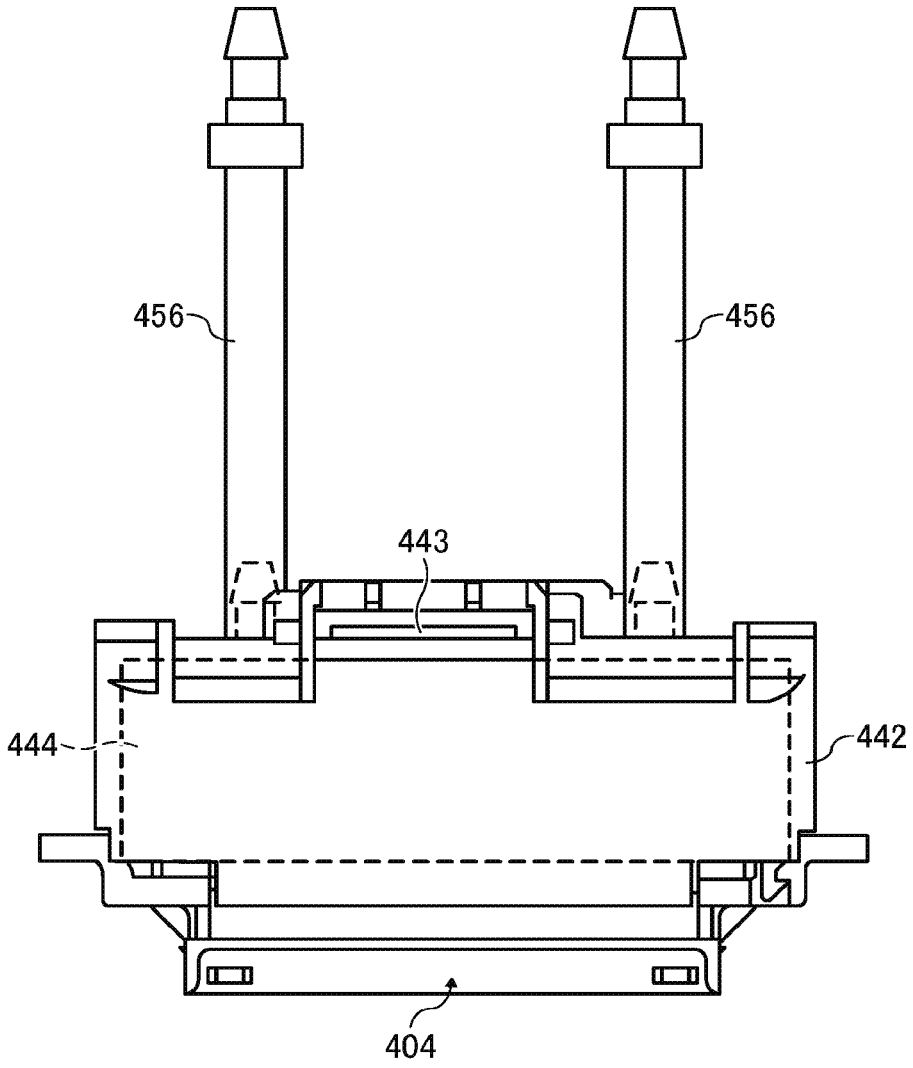
FIG. 9 is a side view illustrating an example of a liquid discharge device.

A liquid discharge device includes the above described liquid discharge head according to an embodiment of the present disclosure. FIGS. 7 through 9 each illustrate an example of a liquid discharge device according to the present embodiment. A "liquid discharge device" is formed by integrating other functional components and mechanisms in a liquid discharge head and is an assembly of components relating to a liquid discharge function. For example, a "liquid discharge device" may include a combination of a liquid discharge head and at least one of a head tank, a carriage, a supply mechanism, a maintenance/recovery mechanism, and a main scanning movement mechanism. Examples of the integrated structure include a combination in which a liquid discharge head, functional components, and mechanisms are secured to one another by fastening, bonding, or engaging, for example, and a combination in which one of the head and each component is movably supported by the other. Alternatively, the liquid discharge head, the functional components, and the mechanisms may be detachably attached to one another.

An example of the liquid discharge device is a liquid discharge device 440 that is a combination of a liquid discharge head 404 and a head tank 441, as illustrated in FIG. 7. The liquid discharge device 440 illustrated in FIG. 7 is mounted in a carriage 403. The carriage 403 is held by a guide member 401 forming a main scanning movement mechanism and reciprocates in the main scanning direction.

FIG. 7 illustrates a conveyance belt 412 that is a means for transporting a recording medium (such as a paper sheet) among the components constituting the liquid discharge apparatus described later. The conveyance belt 412 is an endless belt and is stretched between a conveyance roller 413 and a tension roller 414.

Alternatively, the liquid discharge head and the head tank may be integrally connected to each other with a tube or the like. In this case, a unit that includes a filter may be added between the head tank and the liquid discharge head of the liquid discharge device. Alternatively, the liquid discharge head and the carriage may be integrated, to form a liquid discharge device. Further, an example of the liquid discharge device is a structure in which the liquid discharge head 404 is movably supported by the guide member 401 that forms part of a main scanning movement mechanism 493, and the liquid discharge head 404 and the main scanning movement mechanism 493 are integrated.

Yet another example of the liquid discharge device is a structure in which the liquid discharge head 404, the carriage 403, and the main scanning movement mechanism 493 are integrated, as illustrated in FIG. 8. The liquid discharge device illustrated in FIG. 8 includes a housing portion formed with side plates 491A and 491B and a back plate 491C, the main scanning movement mechanism 493, the carriage 403, and the liquid discharge head 404 of the components constituting the liquid discharge apparatus described later. An arrow D1 in the drawing indicates the main scanning direction.

Another example of the liquid discharge device is a structure in which the cap that is part of the maintenance/recovery mechanism is secured to the carriage to which the liquid discharge head is attached, and the liquid discharge head, the carriage, and the maintenance/recovery mechanism are integrated.

Yet another example of the liquid discharge device is a structure in which a tube 456 is connected to the liquid discharge head 404 to which a channel component 444 is attached as illustrated in FIG. 9, and the liquid discharge head 404 and the supply mechanism are integrated. Through this tube 456, the liquid in the liquid storage source is supplied to the liquid discharge head 404. The channel component 444 is disposed inside a cover 442. Instead of the channel component 444, the head tank 441 may be included. Further, a connector 443 that is electrically connected to the liquid discharge head 404 is provided above the channel component 444.

The main scanning movement mechanism may also include the guide member. The supply mechanism may also include a tube or a loading member.

Liquid Discharge Apparatus

Figure 10:
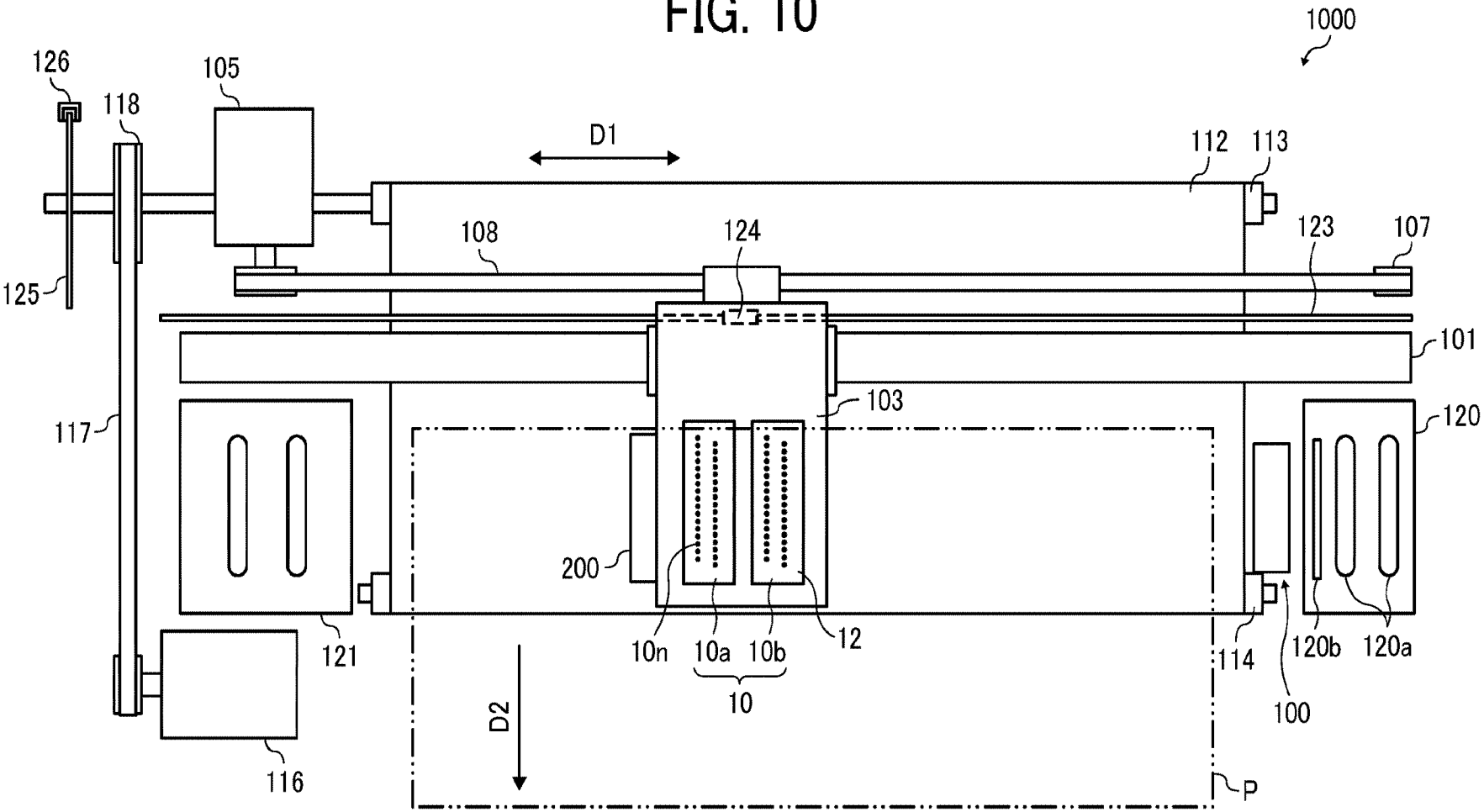
FIG. 10 is a plan view for explaining a mechanical section illustrating an example of a liquid discharge apparatus.

FIG. 10 illustrates a serial type image forming apparatus as an example of a liquid discharge apparatus. FIG. 10 is a plan view for explaining the mechanical section of the liquid discharge apparatus. A liquid discharge apparatus 1000 according to an embodiment of the present disclosure has a sub tank and an air tank attached to liquid discharge heads 10*a* and 10*b* (referred to as the "liquid discharge head 10" unless distinguished from each other).

In the liquid discharge apparatus illustrated in FIG. 10, a carriage 103 is movably held by a main guide member 101 laterally bridging on left and right side plates and a sub guide member. A main scanning motor 105 reciprocates the carriage 103 in the main scanning direction (carriage moving direction) D1 via a timing belt 108 stretched between a driving pulley 106 and a driven pulley 107.

The liquid discharge head 10 is mounted on the carriage 103. The liquid discharge head 10 discharges ink droplets of the respective colors of yellow (Y), cyan (C), magenta (M), and black (K), for example. Further, in the liquid discharge head 10, a nozzle row 10*n* formed with a plurality of nozzles is disposed in a sub-scanning direction D2 orthogonal to a main scanning direction D1. The liquid discharge head 10 is mounted, with the droplet discharge direction facing downward.

A liquid discharge head that can be used as the liquid discharge head 10 may be a piezoelectric actuator such as a piezoelectric element, or a thermal actuator that utilizes phase change due to film boiling of a liquid, using an electrothermal conversion element such as a heating resistor, for example.

Meanwhile, to convey a paper sheet P, a sheet conveyance belt 112 that is a sheet conveyor for electrostatically attracting a paper sheet and conveying the paper sheet at a position facing the liquid discharge head 10 is provided. This sheet conveyance belt 112 is an endless belt, and is stretched between a belt conveyance roller 113 and a tension roller 114.

When the belt conveyance roller 113 is rotatingly driven by a sub-scanning motor 116 via a timing belt 117 and a timing pulley 118, the sheet conveyance belt 112 rotates in the sub-scanning direction D2. The sheet conveyance belt 112 is electrically charged (supplied with charge) by a charging roller while rotating.

Further, a maintenance/recovery mechanism (a cleaner) 120 that performs maintenance/recovery of the liquid discharge head 10 is disposed on one side of the carriage 103 in the main scanning direction D1 and by the side of the sheet conveyance belt 112, and a dummy discharge receptacle 121 that receives dummy discharge from the liquid discharge head 10 is disposed on the other side of the carriage 103 and by the side of the sheet conveyance belt 112. The maintenance/recovery mechanism 120 includes a cap 120*a* for capping the nozzle surface 12 of the liquid discharge head 10, a wiping mechanism 120*b* for wiping the nozzle surface 12, and a dummy discharge receptacle for discharging liquid droplets not contributing to image formation, for example. The wiping mechanism 120*b* includes at least a long wiping member (described later) capable of absorbing liquid, and may further include a blade-like member formed with an elastic material (such as rubber).

Further, a discharge sensor unit 100 is disposed in a region outside the recording area between the sheet conveyance belt 112 and the maintenance/recovery mechanism 120, and, in the region, the discharge sensor unit 100 can face the liquid discharge head 10. Meanwhile, a cleaning unit 200 that cleans the electrode plate of the discharge sensor unit 100 is provided on the carriage 103.

Further, an encoder scale 123 on which a predetermined pattern is formed is stretched in the main scanning direction D1 between both side plates of the carriage 103, and an encoder sensor 124 formed with a transmissive photosensor that reads the pattern on the encoder scale 123 is provided on the carriage 103. The encoder scale 123 and the encoder sensor 124 constitute a linear encoder (a main scanning encoder) that detects movement of the carriage 103.

Further, a code wheel 125 is attached to the shaft of the belt conveyance roller 113, and an encoder sensor 126 formed with a transmissive photosensor that detects a pattern on the code wheel 125 is provided. The code wheel 125 and the encoder sensor 126 constitute a rotary encoder (a sub scanning encoder) that detects the amount of movement and the position of movement of the sheet conveyance belt 112.

In the image forming apparatus formed as described above, a paper sheet P is fed from a sheet feed tray onto an electrically charged sheet conveyance belt 112 and is attracted to the electrically charged sheet conveyance belt 112. As the sheet conveyance belt 112 rotationally moves, the paper sheet P is conveyed in the sub-scanning direction D2.

The liquid discharge head 10 is then driven in accordance with an image signal while the carriage 103 is moved in the main scanning direction D1. Ink droplets are discharged onto the still paper sheet P, to record one line. The paper sheet P is then conveyed by a predetermined amount, and the next line is recorded.

When a recording end signal or a signal indicating that the rear edge of the paper sheet P has reached the recording area, the recording operation is ended, and the paper sheet P is ejected onto an output tray.

Figure 11:
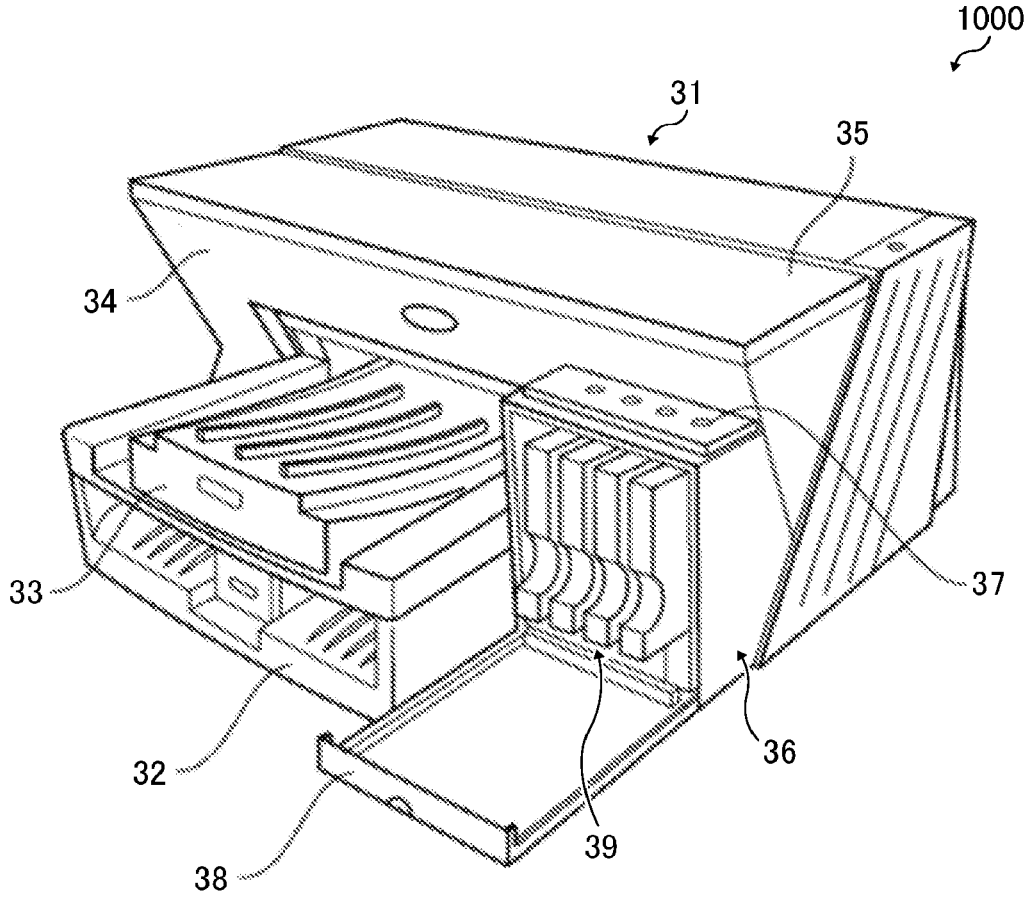
FIG. 11 is a perspective view of another example of a liquid discharge apparatus.

FIG. 11 is a perspective view of another example of the liquid discharge apparatus illustrated as an image forming apparatus. The liquid discharge apparatus 1000 illustrated in FIG. 11 includes an apparatus body 31, a sheet feed tray 32, a sheet ejection tray 33, a cartridge loading unit 36, and an operation unit 37. The sheet feed tray 32 is attached to the apparatus body 31 to load paper sheets as recording media. Paper sheets on which images are formed are stacked on the sheet ejection tray 33. The cartridge loading unit 36 is disposed at one end portion of a front face 34 of the apparatus body 31. The cartridge loading unit 36 projects forward from the front face 34 and is disposed lower than an upper face 35 of the apparatus body 31.

The operation unit 37 including, e.g., operation keys or indicators, is disposed on an upper face of a portion projecting from the front face 34 of the apparatus body 31. Note that the cartridge loading unit 36 includes a front cover 38 operable and closable to allow attachment and detachment of ink cartridges 39 as ink storage tanks (main tanks).

In FIG. 11, the four ink cartridges 39 (for four colorants, e.g., black, cyan, magenta, and yellow) are illustrated. However, in addition the four ink cartridges 39, for example, one to four treatment-liquid cartridges (for colorant inks requiring treatment liquid) may be loaded. Note that treatment liquid may not be needed for, e.g., a color having a high discharge reliability.

Note that a "liquid discharge apparatus" in this specification is an apparatus that includes a liquid discharge head or a liquid discharge device, and drives and causes the liquid discharge head to discharge liquid. Other than the above example, a "liquid discharge apparatus" may be an apparatus capable of discharging liquid into air or liquid, instead of an apparatus capable of discharging liquid onto a medium to which liquid can adhere. This "liquid discharge apparatus" may also be an apparatus relating to feeding, conveyance, and sheet ejection of a medium to which liquid can adhere, a preprocessing apparatus, a post-processing apparatus, or the like.

For example, a "liquid discharge apparatus" may be an image forming apparatus that forms an image on a paper sheet by discharging ink, or a stereoscopic fabricating apparatus (a three-dimensional fabricating apparatus) that discharges a fabricating liquid onto a powder layer formed from powder, to fabricate a solid object (a three-dimensional object). A "liquid discharge apparatus" is not necessarily an apparatus that discharges liquid to visualize meaningful images, such as characters or figures. For example, a liquid discharge apparatus may form meaningless images, such as meaningless patterns, or form three-dimensional images.

The "medium to which liquid can adhere" means a medium to which liquid can at least temporarily adhere, a medium to which liquid adheres and sticks, a medium to which liquid adheres and penetrates, or the like. Specific examples of such media include recording media such as paper sheets, recording paper, recording sheets, film, and cloth, electronic components such as electronic substrates, piezoelectric elements, and media such as powder layers (powdery layers), organ models, and test cells. The specific examples include all media to which liquid can adhere, unless otherwise specified.

The material of the above "medium to which liquid can adhere" should be a medium to which liquid can temporarily adhere, such as paper, thread, fiber, cloth, leather, metal, plastic, glass, wood, or ceramics.

Meanwhile, the "liquid" is not limited to any particular liquid, as long as the liquid has such a viscosity or surface tension that the liquid can be discharged from a head. However, the viscosity of the liquid is preferably not higher than 30 mPa·s under ordinary temperature and ordinary pressure, or by heating or cooling. More specifically, the liquid may be a solution, a suspension, or an emulsion containing a solvent such as water or an organic solvent, a colorant such as a dye or a pigment, a functionalizing material such as a polymerizable compound, a resin, or a surfactant, a biocompatible material such as DNA, amino acid, protein, or calcium, an edible material such as a natural pigment, or the like. Any of these liquids can be used as an inkjet ink, a surface treatment liquid, a liquid for forming components or an electronic circuit resist pattern for electronic elements or light-emitting elements, a three-dimensional fabricating material solution, or the like.

Alternatively, a "liquid discharge apparatus" may be an apparatus in which a liquid discharge head and a medium to which liquid can adhere move relative to each other, but is not necessarily such an apparatus. Specific examples of such apparatuses include a serial type head apparatus that moves the liquid discharge head, and a line head apparatus that does not move the liquid discharge head.

Further, a "liquid discharge apparatus" may be a treatment liquid application apparatus that discharges a treatment liquid onto a paper sheet to apply the treatment liquid onto the surface of the paper sheet and modify the surface of the paper sheet, or an injecting granulation apparatus that granulates fine particles of a raw material by spraying a composition liquid containing the raw material dispersed in a solution through a nozzle, or the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge head comprising:
- a nozzle configured to discharge liquid;
- a cover covering at least a part of the liquid discharge head except the nozzle;
- a connector board including:
  - a connector to be detachably connected to an external wiring component that is not part of the liquid discharge head, wherein the cover is not part of the external wiring component; and
  - a first engaging portion configured to engage the cover in a first direction; and
- a cap detachably attached to the cover, the cap including:
  - an opening configured to engage at least one of the connector and the connector board in a second direction intersecting the first direction and expose at least a part of the connector; and
  - a second engaging portion configured to engage the cover in a third direction.

2. The liquid discharge head according to claim 1, wherein the first direction is substantially orthogonal to the second direction.

3. The liquid discharge head according to claim 1, wherein the third direction is substantially parallel to the second direction.

4. The liquid discharge head according to claim 1, further comprising a terminal unit connected to the wiring component, wherein the terminal unit is disposed to project from the opening of the cap.

5. The liquid discharge head according to claim 1, wherein the opening of the cap is opposite to the nozzle.

6. The liquid discharge head of claim 1, wherein the cover includes a third engaging portion to engage with the first engaging portion of the connector board.

7. The liquid discharge head of claim 1, wherein the cover includes a fourth engaging portion to engage with the second engaging portion of the cap.

8. The liquid discharge head of claim 1, wherein a direction in which the connector is connected to the external wiring component is perpendicular to the first direction in which the first engaging portion engages the cover.

9. A liquid discharge device, comprising:

a movable carriage; and a plurality of liquid discharge heads mounted on the carriage, the liquid discharge heads including:

a nozzle configured to discharge liquid;

a cover covering at least a part of the liquid discharge heads except the nozzle;

a connector board including:

a connector to be detachably connected to an external wiring component that is not part of the liquid discharge head, wherein the cover is not part of the external wiring component; and a first engaging portion configured to engage the cover in a first direction; and a cap detachably attached to the cover, the cap including:

an opening configured to engage at least one of the connector and the connector board in a second direction intersecting the first direction and expose at least a part of the connector; and a second engaging portion configured to engage the cover in a third direction.

10. The liquid discharge device according to claim 9, wherein the first direction is substantially orthogonal to the second direction.

11. The liquid discharge device according to claim 9, wherein the third direction is substantially parallel to the second direction.

12. The liquid discharge device according to claim 9, further comprising a terminal unit connected to the wiring component, wherein the terminal unit is disposed to project from the opening of the cap.

13. The liquid discharge device according to claim 9, wherein the opening of the cap is opposite to the nozzle.

14. A liquid discharge apparatus, comprising:

a cartridge configured to store liquid;

a feed tray configured to feed a medium;

an ejection tray configured to receive the medium; and a liquid discharge device configured to receive the liquid from the cartridge, the liquid discharge device including:

a movable carriage; and a plurality of liquid discharge heads mounted on the carriage, the liquid discharge heads including:

a nozzle configured to discharge liquid;

a cover covering at least a part of the liquid discharge heads except the nozzle;

a connector board including:

a connector to be detachably connected to an external wiring component that is not part of the liquid discharge head, wherein the cover is not part of the external wiring component; and a first engaging portion configured to engage the cover in a first direction; and a cap detachably attached to the cover, the cap including:

an opening configured to engage at least one of the connector and the connector board in a second direction intersecting the first direction and expose at least a part of the connector; and a second engaging portion configured to engage the cover in a third direction.

15. The liquid discharge apparatus according to claim 14, wherein the first direction is substantially orthogonal to the second direction.

16. The liquid discharge apparatus according to claim 14, wherein the third direction is substantially parallel to the second direction.

17. The liquid discharge apparatus according to claim 14, further comprising a terminal unit connected to the wiring component, wherein the terminal unit is disposed to project from the opening of the cap.

18. The liquid discharge apparatus according to claim 14, wherein the opening of the cap is opposite to the nozzle.

* * * * *